US011079150B2

(12) United States Patent
Pasarkar et al.

(10) Patent No.: US 11,079,150 B2
(45) Date of Patent: Aug. 3, 2021

(54) METHOD FOR CONTROLLING LEVEL OF LIQUID WITHIN AN EVAPORATOR AND A SYSTEM THEREOF

(71) Applicant: BLUE STAR LIMITED, Maharashtra (IN)

(72) Inventors: Sandeep Pasarkar, Maharashtra (IN); Zaid Hetavkar, Maharashtra (IN)

(73) Assignee: BLUE STAR LIMITED, Maharashtra (IN)

( * ) Notice: Subject to any disclaimer, the term of this patent is extended or adjusted under 35 U.S.C. 154(b) by 121 days.

(21) Appl. No.: 16/280,544

(22) Filed: Feb. 20, 2019

(65) Prior Publication Data

US 2019/0257561 A1 Aug. 22, 2019

(30) Foreign Application Priority Data

Feb. 20, 2018 (IN) ..... 201821006367

(51) Int. Cl.

*F25B 49/02* (2006.01)
*F25B 39/00* (2006.01)
*F25B 39/02* (2006.01)

(52) U.S. Cl.

CPC ..... *F25B 49/02* (2013.01); *F25B 39/00* (2013.01); *F25B 39/02* (2013.01); *F25B 2339/0242* (2013.01); *F25B 2600/05* (2013.01); *F25B 2700/15* (2013.01); *F25B 2700/1931* (2013.01); *F25B 2700/1933* (2013.01); *F25B 2700/2103* (2013.01); *F25B 2700/21152* (2013.01)

(58) Field of Classification Search

CPC ..... F25B 49/02; F25B 39/00; F25B 39/02; F25B 2339/0242; F25B 2339/024; F25B 2700/2103; F25B 2700/1933; F25B 2700/21152; F25B 2700/04; F25B 2700/21173; F25B 2600/05; F25B 2600/2513; F25B 41/062

See application file for complete search history.

(56) References Cited

U.S. PATENT DOCUMENTS 3,365,900 A * 1/1968 Clark ..... F25B 1/00 62/115
3,452,552 A * 7/1969 Johnson ..... F25B 15/06 62/141
3,625,021 A * 12/1971 Dyre ..... F25B 15/06 62/148

(Continued)

*Primary Examiner* — Kun Kai Ma
(74) *Attorney, Agent, or Firm* — Knobbe, Martens, Olson & Bear LLP

(57) ABSTRACT

A method controls the level of liquid within an evaporator of a flooded-type chiller without level sensors. The flooded-type chiller includes at least one compressor, a condenser, an expansion valve and an evaporator. A number of sensors positioned in the system measures a number of first parameter information values. A controller calculates a number of second parameter information values based on the measured first parameter information values and further determines a virtual refrigerant level as a control signal based on the second parameter information values. Based on the determined virtual refrigerant level, the controller opens, closes or holds the expansion valve with respect to a dead zone for maintaining a pre-defined target refrigerant level so as to provide the desired refrigerant level and oil in the evaporator.

10 Claims, 12 Drawing Sheets

(56) References Cited

U.S. PATENT DOCUMENTS

| | | | | |
|---|---|---|---|---|
| 5,809,795 | A * | 9/1998 | Beaverson | G01F 23/266 62/218 |
| 5,857,347 | A * | 1/1999 | Haugen | F25B 41/00 62/204 |
| 6,035,651 | A * | 3/2000 | Carey | F04C 28/06 62/115 |
| 6,318,101 | B1 * | 11/2001 | Pham | F25B 41/062 62/225 |
| 8,046,107 | B2 * | 10/2011 | Zugibe | F25B 43/02 700/275 |
| 8,919,139 | B2 * | 12/2014 | Yamada | F25B 49/005 62/129 |
| 9,217,592 | B2 * | 12/2015 | Turney | F25B 45/00 |
| 9,677,795 | B2 * | 6/2017 | Hartfield | F25B 39/00 |
| 2006/0059926 | A1 * | 3/2006 | McCormick | B60H 1/3205 62/129 |
| 2008/0307810 | A1 * | 12/2008 | VanderZee | F25B 49/02 62/222 |
| 2010/0326108 | A1 * | 12/2010 | Schreiber | F28F 9/22 62/218 |
| 2013/0031933 | A1 * | 2/2013 | Manzo | F24F 11/30 62/498 |
| 2014/0013782 | A1 * | 1/2014 | Kopko | F25B 49/025 62/115 |
| 2020/0018529 | A1 * | 1/2020 | Schreiber | F25B 13/00 |

* cited by examiner

METHOD FOR CONTROLLING LEVEL OF LIQUID WITHIN AN EVAPORATOR AND A SYSTEM THEREOF

PRIORITY AND CROSS REFERENCE TO RELATED APPLICATIONS

This application claims the benefit of Indian Patent Application No. 201821006367, filed on Feb. 20, 2018, which is hereby incorporated by reference in its entirety.

TECHNICAL FIELD

The present invention relates generally to the field of a flooded type chiller control systems. More particularly, the present invention relates to a method and a system for controlling the level of liquid refrigerant within an evaporator of the flooded type chiller system.

BACKGROUND

Flooded type chillers are the chillers in which evaporator is a shell and tube heat exchanger wherein refrigerant is on the shell side of the evaporator and water/fluid to be cooled is on the tube side of the evaporator. In a flooded type chiller system, a compressor compresses refrigerant gas and the condenser receives the compressed refrigerant gas and condenses to a liquid refrigerant. The liquid refrigerant from the condenser passes through an expansion device, thereby lowering the pressure of the refrigerant liquid before reaching an evaporator. The evaporator vaporizes the liquid refrigerant in shell and returns to a suction inlet of the compressor to repeat the process.

The expansion device can incorporate a valve to regulate the flow of refrigerant between the condenser and the evaporator (e.g. an electronic expansion valve (EXV)). The expansion valve in the system acts as a main flow control which permits the refrigerant to expand from the high-pressure refrigerant liquid of the condenser to the lower pressure refrigerant liquid. It then enters in the shell of an evaporator where heat exchange with water in the tube causes it to become Low Pressure Refrigerant Vapour. As the heat from the water being cooled boils the refrigerant, the evaporator shell fills with refrigerant vapour, and the liquid level of the refrigerant drops. To compensate for this, Electronic Expansion valve (EXV) opens to feed additional refrigerant to the evaporator. Therefore, it is desired to know how the liquid refrigerant level is varying, in order to keep the liquid refrigerant level at the proper level, so that liquid refrigerant continues to cover the heat exchanger. A level that is too high causes liquid refrigerant flood back while too low a level degrades performance. Both these conditions cause abnormal operation and tripping on safety. It is also known that the liquid refrigerant flood back causes oil carryover. It is also very well known that when oil gets into the evaporator, it mixes with refrigerant and degrades system efficiency and capacity. This occurs when the evaporator tubes become coated with oil, creating a thermal barrier. The heat transfer efficiency retards and drastically reduces the cooling effect". As per ASHRAE study titled "Effects of Oil on Boiling of Replacement Refrigerants Flowing Normal to a Tube Bundle, Part I: R-123 and Part II: R-134a." shows a marked decrease in heat transfer with the addition of even a small amount of oil throughout various heat loadings. Even at 1 percent to 2 percent oil, the heat transfer coefficient reduces to one-third from its no oil baseline. At substantial oil content (5 percent to 15 percent), a 40 percent to 50 percent reduction (in heat transfer) occurs.

Referring FIG. 2 shows using a commonly known system for determining the refrigerant level in the evaporator. As shown in FIG. 2, sensors (202) provide inputs and the expansion valve EXV uses these inputs to determine and control the refrigerant level inside the evaporator (200). A level gauge (201) that fits to the Evaporator (200) adapts the sensors. A lot of problems arise due to the mounting the sensor (202) on the evaporator. Further, such adaption requires precisions in using the inputs to determine the liquid level (203) within the evaporator. Moreover, it is very well known that cost of the refrigerant level sensor (202) is high and it requires an additional Level chamber (201). Also, it requires additional labour, process, electrical harness, mounting of Programmable Communicating Thermostats (PCT's), supply transformers etc.

Therefore, there is a need to overcome one or more abovementioned drawbacks.

SUMMARY

Accordingly, an aspect of the present invention discloses a method for controlling level of liquid within an evaporator of a flooded-type chiller without level sensors, the flooded-type chiller including at least one compressor, a condenser, an expansion valve and the evaporator being arranged in series, the method comprising the steps of measuring a plurality of first group of parameters using a plurality of sensors positioned in the flooded-type chiller; calculating a plurality of second group of parameters using the measured value of the first group of parameters by a controller having at least one processor, in communication with said plurality of sensors; determining a virtual refrigerant level as a control signal based on the second group of parameter values by a controller; and controlling a desired refrigerant level in the evaporator by controlling operation of said expansion valve based on said determined virtual refrigerant level with respect to a dead zone for maintaining a pre-defined target refrigerant level.

According to an embodiment, the method further comprises a step of monitoring the operation of the flooded-type chiller at a pre-defined interval.

In said embodiment, the predefined interval at starting of the flooded-type chiller is 2-5 minutes and the predefined interval during continuous operation of the flooded-type chiller is 10-60 seconds.

In said embodiment, the pre-defined target refrigerant level is in the range of 20 to 35%.

In said embodiment, said controller invokes said control signal to hold said expansion valve, when said determined virtual refrigerant level in a dead zone. In said embodiment, the step controlling a desired refrigerant level includes closing the expansion valve when the virtual refrigerant level is above the dead zone and opening the expansion valve when the virtual refrigerant level is below the dead zone.

According to the embodiment, the method further comprises a step of invoking said control signal to close said expansion valve by increasing virtual refrigerant level above the dead zone, when there is decrease of discharge superheat caused due to excess oil in said evaporator; unloading the evaporator to return the oil to the oil separator; and invoking said control signal to open said expansion valve by decreasing virtual refrigerant level below the dead zone, thereby increasing discharge superheat.

In said embodiment, said first group of parameters include suction pressure, discharge pressure, leaving water temperature, discharge temperature and current.

In said embodiment, said second group of parameters include pressure ratio, discharge superheat, full load current, load factor, EXV multiplier and discharge superheat factor.

In said embodiment, when said suction pressure reduces and reaches a pre-defined low suction pressure setpoint, said controller invokes said control signal to open said expansion valve, till said suction pressure is more than said pre-defined low suction pressure setpoint.

In said embodiment, the predefined low pressure setpoint is calculated by the controller based on first parameter measured values.

According to another aspect, the present invention discloses, a system for controlling level of liquid within an evaporator of a flooded-type chiller without level sensors, the flooded-type chiller including at least one compressor, a condenser, expansion valve and the evaporator being arranged in series, said system comprising a plurality of sensing means configured for measuring and inputting a plurality of first group of parameter information values; a controller configured for computing a plurality of second group of parameter information values based on said measured values and determining a virtual refrigerant level as a control signal based on said computed values; and a controlling means configured for controlling operation of said expansion valve based on said determined virtual refrigerant level determined by the controller with respect to a predefined target refrigerant level.

In said another aspect, said controlling means includes at least one processor for processing a fuzzy logic that controls operation of said expansion valve and sensing means includes a plurality of sensors positioned in the flooded-type chiller.

BRIEF DESCRIPTION OF THE DRAWINGS

The above and other aspects, features, and advantages of certain exemplary embodiments of the present invention will be more apparent from the following description taken in conjunction with the accompanying drawings in which.

Throughout the drawings, it should be noted that like reference numbers are used to depict the same or similar elements, features, and structures.

DETAILED DESCRIPTION

Figure 1:
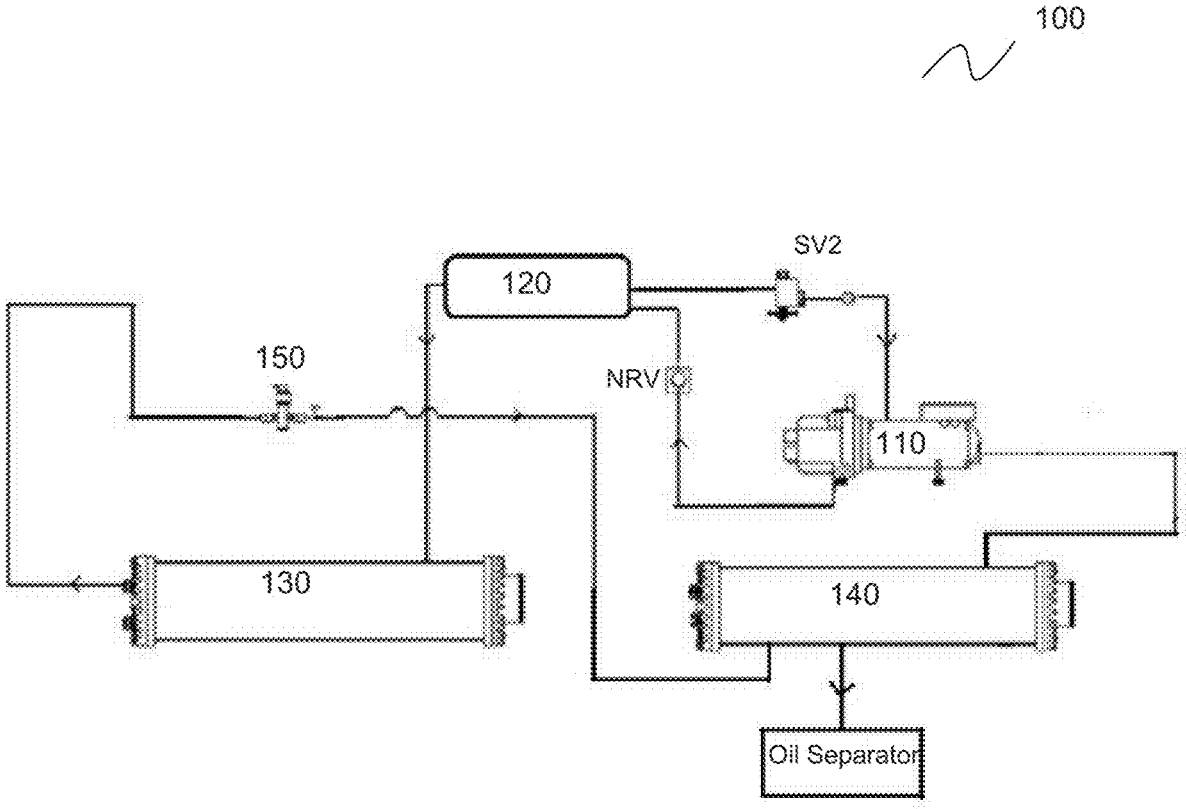
FIG. 1 shows a system diagram of the refrigerant circuit of a standard flooded water-cooled chiller, as an example embodiment of the present invention.
Figure 2:
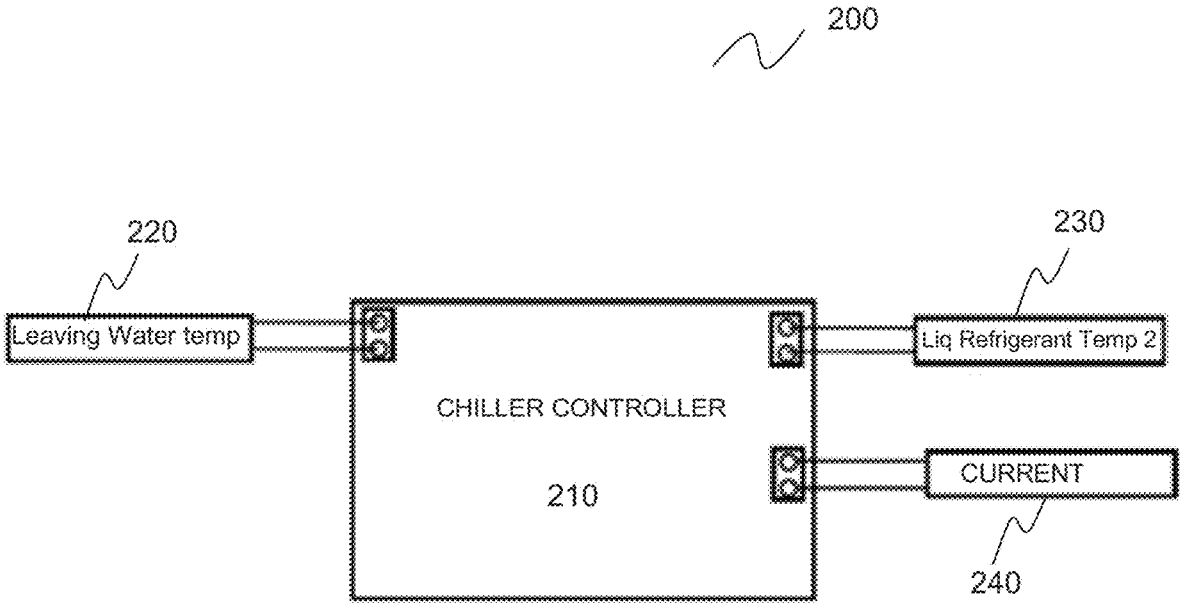
FIG. 2 shows an evaporator of a refrigerant system having refrigerant level sensor and level chamber, according to conventional prior art.

In general, the present invention provides a method for controlling level of liquid within an evaporator of a flooded-type chiller without level sensors, the flooded-type chiller having components including at least one compressor, a condenser, an expansion valve EXV, and the evaporator arranged in series. According to an aspect, a plurality of sensors positioned in the flooded-type chiller measures a plurality of first group of parameter information values and a controller calculates a plurality of second group of parameter information values based on said measured values and further determines a virtual refrigerant level as a control signal based on said the second group of parameter values. Based on determined virtual refrigerant level the controller controls operation of the expansion valve (opens/closes/holds) with respect to a dead zone for maintaining a predefined target refrigerant level and thereby the desired refrigerant level and oil in the evaporator.

According to the present invention, the first group of parameters include but not limited to suction pressure, discharge pressure, leaving water temperature, discharge temperature and current. The suction pressure is the refrigerant pressure measured at the input of the compressor, the discharge pressure is the refrigerant pressure measured at the outlet of the compressor, the leaving water temperature is the water temperature measured at the outlet of the evaporator, the discharge temperature is the refrigerant temperature measured at the outlet of the compressor, and the current is the input current to the compressor.

According to the present invention, the second group of parameters include but not limited to pressure ratio, discharge superheat, full load current, load factor, EXV multiplier and discharge superheat.

The pressure ratio (PR) is the ratio of the discharge pressure and the suction pressure and is determined by the equation:

$$PR=DP/SP \quad (1)$$

Where,

PR—Pressure ration of discharge pressure and the suction pressure;

DP—Discharge pressure measured at discharge point of compressor, kPa;

SP— Suction pressure measured at suction point of compressor, kPa;

The discharge superheat (DSH) is obtained by difference between the discharge temperature and the saturated discharge temperature and is determined by the equation:

$$DSH=DT-\text{Saturated } DT \quad (2)$$

Where,

DSH—Discharge Superheat, ° F.

DT—Discharge temperature measured on discharge line of chiller, ° F.

Saturated DT—Saturated discharge temperature for R134a Refrigerant at measured discharge pressure, ° F.

The load factor (LF) is the ratio of the leaving water temperature and the full load current and is determined by the equation:

$$LF=LWT/FLA \quad (3)$$

Where,

LF—load Factor

LWT—Water temperature measured at the outlet of the Evaporator, ° F.

FLA—Full load Current indicating % at which compressor is running, %

The expansion valve (EXV) multiplier is the ratio of the sum of the EXV capacity to the sum of the discharge superheat, suction pressure and the leaving water temperature, and is determined by the equation:

$$EXV\ Mult=(A+B)/(DSH+SP-+LWT) \quad (4)$$

Where,

EXV Mult—EXV multiplier factor

A—Constant value indicating capacity of EXV when it is at maximum opening position B— Constant value indicating capacity of EXV when it is at minimum opening position DSH—Discharge Superheat, ° F.

SP— Suction pressure measured at suction point of compressor, kPa;

LWT—Water temperature measured at the outlet of the Evaporator, ° F.

The discharge superheat factor (DSHF) is a factor multiplied to the DSH to control the effect of change in discharge superheat and is determined by the equation:

$$\text{DSHF}=DSH*C \quad (5)$$

Where,

DSHF—Discharge Superheat factor

DSH—Discharge Superheat, ° F.

C— Constant

According to the aspect of the present invention, the controller calculates a virtual refrigerant level as a control signal based on the second group of parameter values. Based on determined virtual refrigerant level the controller controls operation of the expansion valve with respect to a dead zone for maintaining a pre-defined target refrigerant level thereby the desired refrigerant level/oil in the evaporator. The virtual refrigerant level is determined by the following equation:

$$Vr\ \text{Ref}\ Lvl=D-(PR+LF+\text{EXVMULT}+\text{DSHF}\pm E) \quad (6)$$

Where,

Vr Ref Lvl—Virtual refrigerant level

D—Constant dependent on capacity in TR of the chiller

PR— Pressure ratio obtained in Equation 1

LF—Load factor obtained in equation 3

EXV Mult—EXV multiplier factor obtained in equation 4

DSHF—Discharge Superheat factor obtained in equation 5

E—Constant dependent on capacity in TR of the chiller

Other aspects, advantages, and salient features of the invention will become apparent to those skilled in the art from the following detailed description, which, taken in conjunction with the annexed drawings, discloses exemplary embodiments of the invention.

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

Figures discussed below, and the various embodiments used to describe the principles of the present disclosure in this patent document are by way of illustration only and should not be construed in any way that would limit the scope of the disclosure. Those skilled in the art will understand that the principles of the present disclosure may be implemented in any suitably arranged environment. The terms used to describe various embodiments are exemplary. It should be understood that these are provided to merely aid the understanding of the description, and that their use and definitions in no way limit the scope of the invention. Terms first, second, and the like are used to differentiate between objects having the same terminology and are in no way intended to represent a chronological order, unless where explicitly stated otherwise. A set is defined as a non-empty set including at least one element.

Referring FIG. 1 shows a system diagram of the refrigerant circuit of a standard flooded water-cooled chiller, as an example embodiment of the present invention. As seen in FIG. 1, the refrigeration system (100) have components that includes at least one compressor (110), a condenser (130), an evaporator (140) for evaporating a refrigerant, being arranged in series with the expansion valve (150). The system (100) further includes an oil separator (120). According to an aspect, the present invention discloses a method of operating the expansion valve (150) of a chiller system (100) in order to better maintain a desired liquid refrigerant level in the evaporator (140) for optimum chiller system operating efficiency. The flow of refrigerant (liquid or gas) through the valve is dependent upon the pressures in the condenser and the evaporator and on the geometry and positioning of the valve. Ideally, the valve is positioned such that the resistance to fluid flow in the expansion device matches that required to optimize the flow to the evaporator. Further, the refrigerant circuit may include one or more processor and a plurality of sensors which are positioned at various components in the circuit. The processor and the sensors are operatively coupled to retrieve various parameter information for processing.

Figure 3:
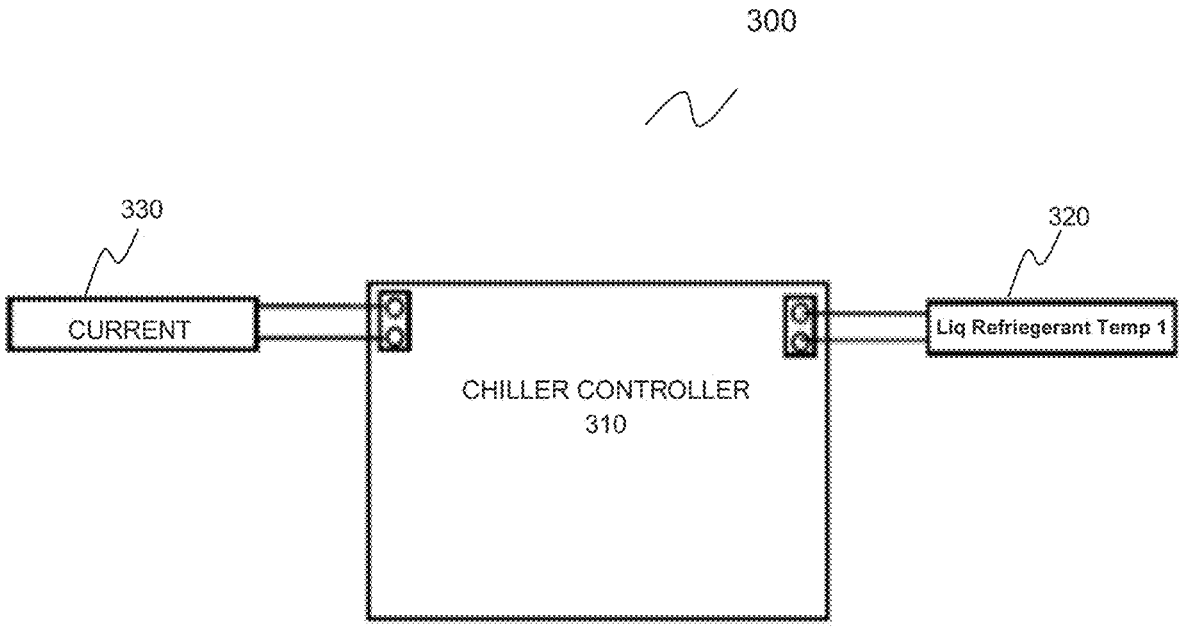
FIG. 3 shows the controller of the chiller, according to one embodiment of the present invention.

Referring FIG. 3 shows the controller of the chiller, according to one embodiment of the present invention. The controller (310) may include but not limited to at least one processor, in communication with said plurality of sensors positioned at various components of the system. The chiller controller (310) may retrieve at least the information from compressor and evaporator but not limited to suction pressure (320), water out temperature (330), discharge pressure (340), discharge temperature (350) and the current (360). The suction pressure is the refrigerant pressure measured at the input of the compressor, the discharge pressure is the refrigerant pressure measured at the outlet of the compressor, the leaving water temperature is the water temperature measured at the outlet of the evaporator, the discharge temperature is the refrigerant temperature measured at the outlet of the compressor, and the current is the input current to the compressor. Based on these information values as an input to the chiller controller, the controller is capable of calculating further parameters including virtual refrigerant level which can further operate the expansion valve in an expansion device to control the flow of refrigerant from a condenser and to an evaporator in a chiller system.

Figure 4:
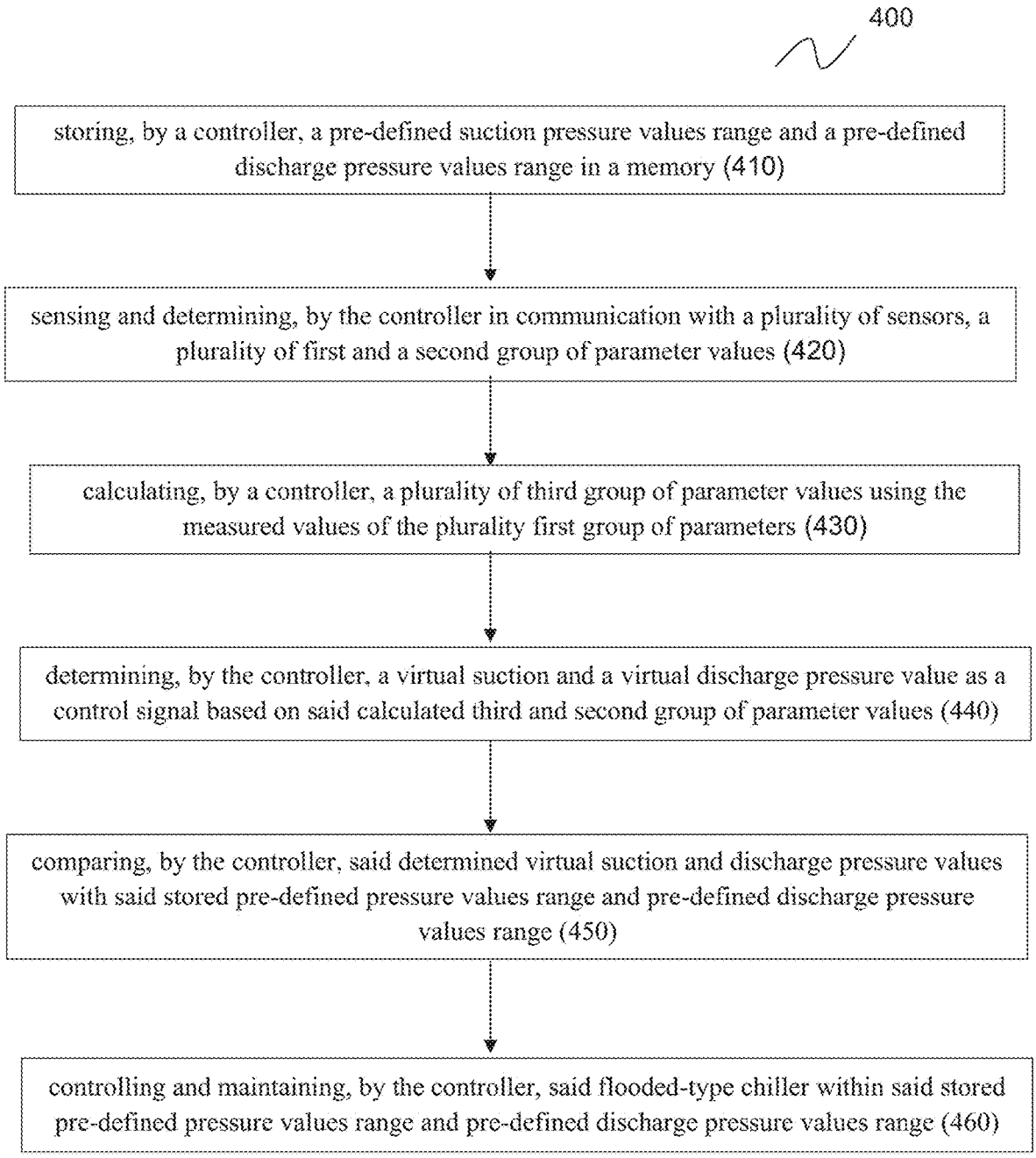
FIG. 4 shows a flow chart of a method for controlling level of liquid within an evaporator of a flooded-type chiller without level sensors, according to an aspect of the present invention.

Referring FIG. 4 shows a flow chart of a method of controlling level of liquid within an evaporator of a flooded-type chiller without level sensors, according to an aspect of the present invention. The method comprising the steps of measuring a plurality of first group of parameters (410) using a plurality of sensors positioned in the flooded-type chiller. The first group of parameters including but not limited to suction pressure, discharge pressure, leaving water temperature, discharge temperature and current. Further, the steps include calculating a plurality of second group of parameters using the measured value of the first group of parameters (420) by a controller having at least one processor, in communication with said plurality of sensors. Furthermore, the method includes the steps of determining a virtual refrigerant level as a control signal based on the second group parameter values (430) and controlling a desired refrigerant level in the evaporator by controlling operation of the expansion valve based on the determined virtual refrigerant level with respect to a dead zone for maintaining a pre-defined target refrigerant level (440).

Figure 5:
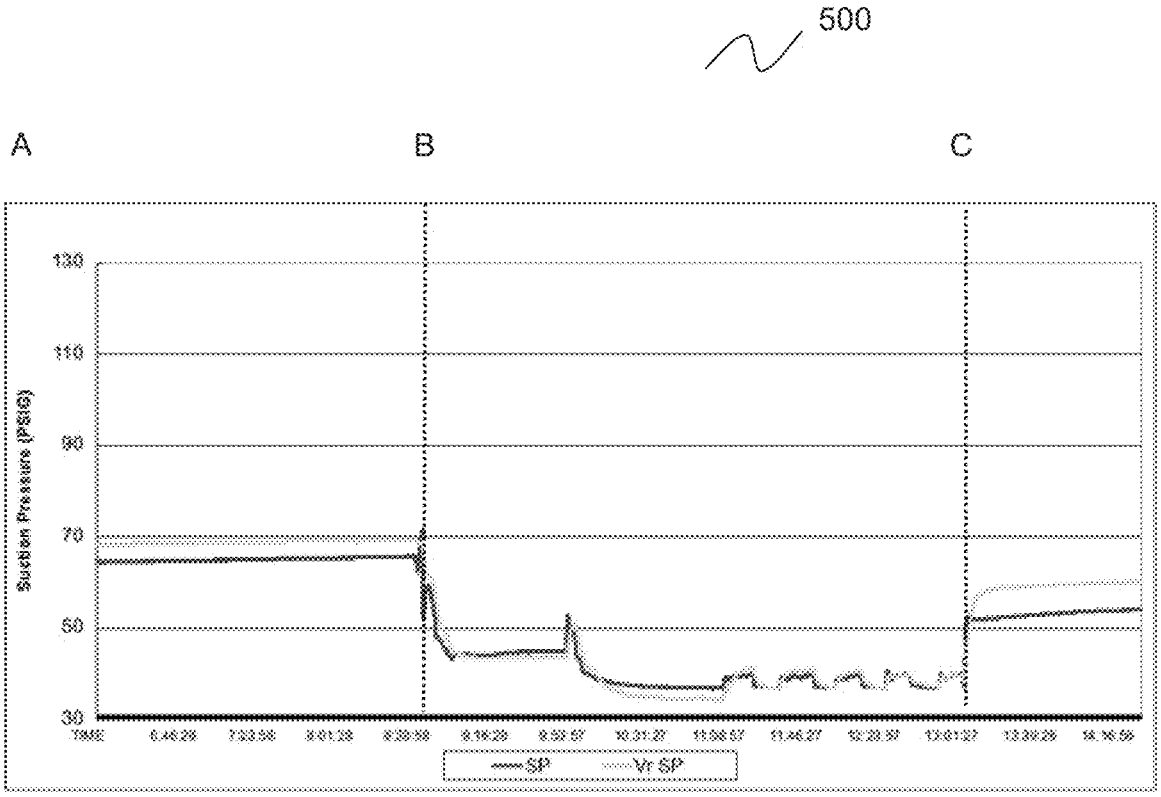
FIG. 5 is a graph which shows operation of the electronic expansion valve in open, close and hold position, if the virtual refrigerant level is above, below or in the dead zone respectively, according to the embodiment of the present invention.

Referring FIG. 5 shows operation of the electronic expansion valve in hold position, if the virtual refrigerant level is in the dead zone, according to the embodiment of the present invention. In the dead zone, the expansion valve partly opens/closes. The controller invokes/sends control signal to hold said expansion valve when said determined virtual refrigerant level in a dead zone. According to the present invention, if the determined virtual refrigerant level is above the dead zone, the controller invokes/sends the control signal to close the expansion valve (450) (Refer FIG. 4), and if the determined virtual refrigerant level is below the dead zone, the controller invokes/send the control signal to open the expansion valve (460) (Refer FIG. 4). The dead zone is determined by the controller and depends on the pre-defined target refrigerant level. The target refrigerant level in the evaporator is determined to be in the range of 20 to 35%.

According to an embodiment, the method further comprises a step of monitoring the operation of the flooded-type chiller at a pre-defined interval.

In said embodiment, the predefined interval at starting of the flooded-type chiller is 2-5 minutes and the predefined interval during continuous operation of the flooded-type chiller is 10-60 seconds.

Further, according to the aspect of the invention, a method of controlling, further comprising the steps of invoking said control signal to close said expansion valve by increasing virtual refrigerant level above the dead zone, when there is decrease of discharge superheat caused due to excess oil in said evaporator unloading the evaporator to return the oil to the oil separator; and there afterwards invoking said control signal to open said expansion valve by decreasing virtual refrigerant level below the dead zone, thereby increasing discharge superheat.

According to the present invention, during startup of compressor, the EXV opens at a pre-set percentage. The EXV is in startup condition for a fixed interval depending on the time set. After startup, it opens and closes according to the Virtual Refrigerant Level. The rate at which EXV opens and closes is settable. During running, the EXV operates on the Virtual refrigerant Level. The Electronic Expansion Valve holds if the Virtual refrigerant Level is in the Dead Zone. The dead zone is defined by a pre-defined target refrigerant level range where the expansion valve does not act unless the reading of the virtual refrigerant level touches the upper or lower bound range. The control of the refrigerant level works same as a Chiller with a Refrigerant Level Sensor installed. The present invention varies with the existing mechanism in the absence of a physical level sensor which is used to measure the refrigerant level inside the evaporator.

Further, electronic expansion valve and Chiller Operation during Oil Carryover in Evaporator, where the Chiller controller unloads the Chiller when the discharge superheat is very close to the tripping point. Closing the Electronic Expansion Valve and running in unloaded condition ensures that the Oil returns back to the Oil Separator (120 of FIG. 1) after running for some time.

Furthermore, the operation of electronic expansion valve when the Suction Pressure reduces, it reaches the Level of Low Suction Pressure Setpoint, the EXV bypasses the standard Logic and starts to open till the Suction Pressure is more than Low Suction Pressure Setpoint. This operation enables the Chiller to operate when the water flow reduces or there has been a refrigerant gas leakage in the system.

In said embodiment, the predefined low pressure setpoint is calculated by the controller based on first parameter measured values.

Figure 6:
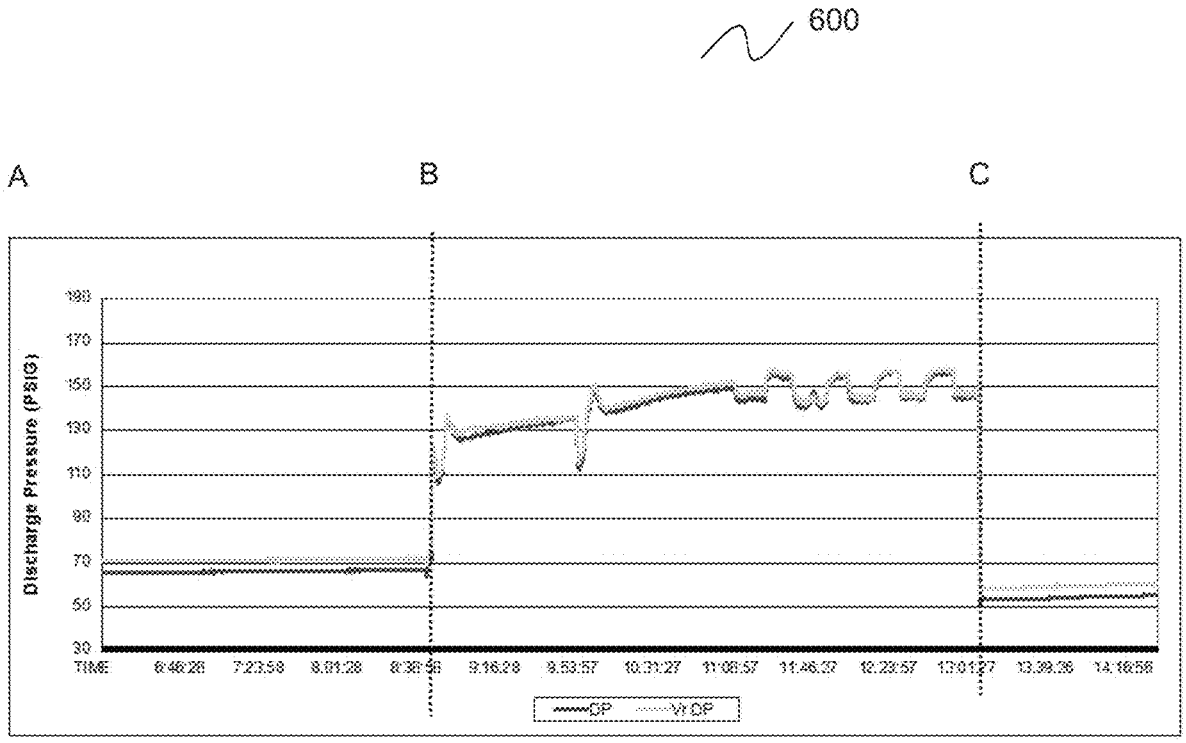
FIG. 6 shows a logic diagram of a method for controlling level of liquid within an evaporator of a flooded-type chiller without level sensors, according to an aspect of the present invention.
Figure 6:
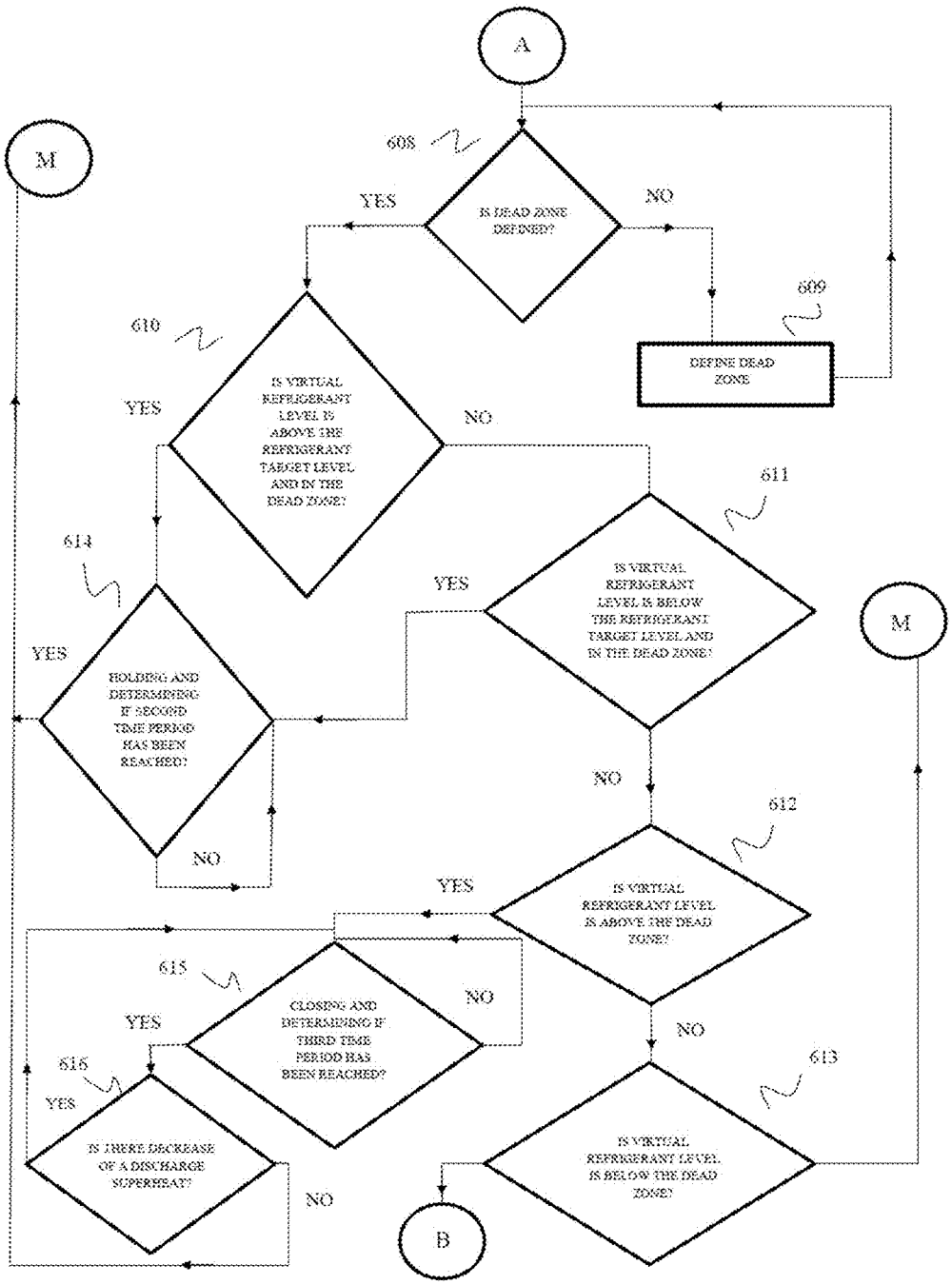

Referring FIG. 6 shows a logic diagram associated with the method of controlling level of liquid within an evaporator of a flooded-type chiller (600) without level sensors, according to the aspect of the present invention. The logic is explained in the following way: when the chiller is starting it is said to be in a "NORMAL MODE" and the controller checks if the first predetermined time period since the chiller has been activated is reached chiller if reached is said to operating in "AUTO MODE" step 601 or the chiller continues to operate in "NORMAL MODE" as indicated at step 602.

As shown in step 603, if the chiller is in "AUTO MODE", the Controller measures plurality of first group of parameters taking an average of at least three readings and then proceeds to step 604.

As shown in step 604, the Controller determines plurality of second group of parameters based on calculated average value of the first group of parameters and then proceeding to step 605.

As shown in step 605, the Controller determines if a refrigerant target level has been defined or not and if refrigerant target level has been defined then it proceeds to step 607 or if refrigerant target level has not been defined then it proceeds to step 606.

As shown in step 606, the Controller defines the refrigerant target level then returns to step 605.

As shown in step 607, the Controller determines a virtual refrigerant level based on said determined second group parameter values and then proceeding to step 608.

As shown in step 608, the Controller determines if a dead zone has been defined or not and if dead zone has been defined then proceeds to step 610 or if dead zone has not been defined then proceeding to step 609.

As shown in step 609, the Controller defined the dead zone then returning to step 608.

As shown in step 610, the Controller determines if the virtual refrigerant level is above the refrigerant target level and in the dead zone and if the refrigerant target level is above and in the dead zone then proceeds to step 614 or if the refrigerant target level is not above then proceeding to step 611.

As shown in step 611, the Controller determines if the virtual refrigerant level is below the refrigerant target level and in the dead zone and if the refrigerant target level is below and in the dead zone then proceeds to step 614 or if the refrigerant target level is not below then proceeding to step 612.

As shown in step 612, the Controller determines if the virtual refrigerant level is above the dead zone and if above then proceeds to step 615 or if the refrigerant target level is not above then proceeding to step 613.

As shown in step 613, the Controller determines if the virtual refrigerant level is below the dead zone and if below then proceeds to step 617 or if the refrigerant target level is not below then returning to step 603.

As shown in step 614, the Controller holds the expansion valve and determines if a second predetermined time period has elapsed since holding the expansion valve and if the second time period has been reached then returns step 603 and if the second time period has not been reached then returning step 614.

As shown in step 615, the Controller closes the expansion valve and determine if a third predetermined time period has elapsed since closing the expansion valve and if the third time period has been reached then proceeding to step 616 and if time period has not been reached then returning step 615.

As shown in step 616, the Controller determines if there is decrease of a discharge superheat caused due to excess oil in the evaporator and if the chiller has unloaded and if there is decrease and chiller has unloaded then returning to step 615 or if there is no decrease then returning to step 603.

As shown in step 617, the Controller opens the expansion valve and determine if a fourth predetermined time period has elapsed since opening the expansion valve and if the time period has been reached then proceeding to step 618 and if time period has not been reached then returning step 617.

As shown in step 618, the Controller determines if there is increase of the discharge superheat in the evaporator and if there is increase then returning to step 617 or if there is no increase then proceeding to step 619.

As shown in step 619, the Controller monitors if suction pressure is above a predefined low pressure setpoint and if above then returning to step 603 and if suction pressure is not above the predefined low pressure setpoint then returning to step 617.

According to an embodiment, the step 603 includes determining if the suction pressure is below the predefined low pressure setpoint and if the suction pressure below the setpoint proceeding to step 617 and if the low suction pressure is not below the setpoint then returning to 603.

In said embodiment, the first time period is at least 2-5 minutes while the second, third and fourth time periods are about 10-60 seconds.

In said embodiment, the predefined low pressure setpoint is calculated by the controller based on first parameter measured values.

Experimental Procedure

A water-cooled chiller having a 160 TR Capacity Twin Circuit Screw Compressor, by way of example is used for conducting tests. The two Refrigeration Circuits are individual circuits of equal capacity (80 TR) with a tube sheet installed between them to separate the two Circuits. Both the Evaporator and the Condenser are of Flooded Type with a Level Sensor installed in the Evaporator of Chiller in each circuit. The physical Level Sensor was installed to compare the performance of the system with virtual level sensor disclosed according to the present invention and physical level sensor commonly known in the art. The expansion device is an Electronic Expansion valve.

The Chiller with virtual refrigerant level detection was configured in the software of the controller as disclosed in the present invention. Physical level sensor was also configured. The control of the EXV was on virtual refrigerant level as disclosed in the present invention. This was done on both the refrigerant circuits of the Chiller. The Chiller was now run at 100% AHRI Condition and the parameters of both the circuits one with control system as disclosed in the present invention and the other with conventional physical sensor known in the art of the Chiller were compared. This was done to ascertain that both the circuits of the Chiller were performing equally and can be used for further comparison. The compressors on the two circuits were individually started. The values of the virtual and actual refrigerant level were compared during the start-up of the Chiller. The Chiller was then run at different operating conditions and at different loading percentage and the values of actual and virtual refrigerant level were compared.

Further to check the operation of oil detection and recovery, the EXV was forcefully opened manually. Opening the EXV more than its requirement results in liquid refrigerant entering the compressor resulting in oil carryover condition from the oil separator to the evaporator. After oil accumulates in the evaporator, the control of the EXV is shifted to Auto Mode.

Table 1 shows the readings of the two Circuits of the Chiller taken at 100% AHRI Condition. Both their EXV's are controlled by their virtual refrigerant level. From the Table, it can be seen that the two Circuits of the Chiller are showing similar readings indicating both the circuits of the Chiller are performing equally and can be used for comparison in further experiments.

TABLE 1

Comparison of Parameters of Circuit 1 and Circuit 2

| | Circuit 1 | Circuit 2 |
|---|---|---|
| Suction Pressure, kPa | 243.4 | 243.4 |
| Discharge Pressure, kPa | 825.0 | 830.1 |
| Current, A | 84 | 84.6 |
| Suction Temperature, ° F. | 47 | 46.9 |
| Discharge Temperature, ° F. | 118.5 | 118.7 |

The above readings have been taken at 100% Load Condition as per AHRI STANDARD 550/590 (I-P)-2018

Figure 7:
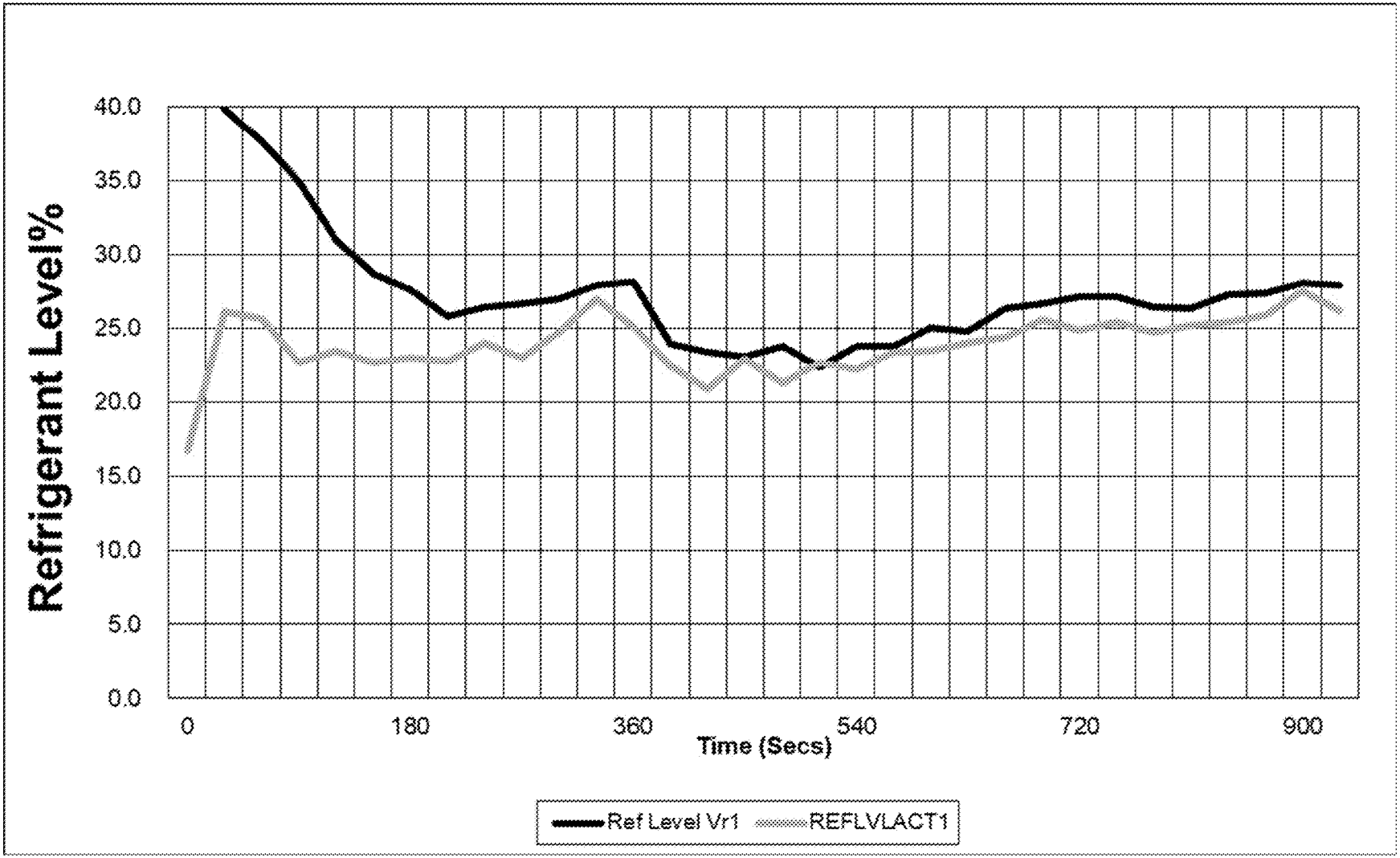
FIG. 7 shows comparison of actual and virtual refrigerant level during start-up of the chiller of a first circuit, according to the present invention.

FIG. 7 shows comparison of actual and virtual refrigerant level during start-up of the chiller of a first circuit, according to the present invention. The control of the EXV is on virtual refrigerant level. From the graph it can be seen in the first 3 minutes the values of the actual and the virtual refrigerant level do not match with each other. The virtual refrigerant level shows a value higher than the actual refrigerant level. When a screw compressor starts, its slide is unloaded to minimum percentage at the time of starting. The EXV is opened to a fixed value during starting. This period lasts for 3 minutes time. After 2 minutes the compressor slide slowly moves ahead and the compressor is loaded dependent on the load requirement. The value of virtual refrigerant level is higher during this period. Higher value of virtual refrigerant level does not affect the system as the EXV is opened at a fixed percentage during this period. The modulation of the EXV starts after this start-up period is complete. Till then the virtual and the actual refrigerant level match with each other.

Figure 8:
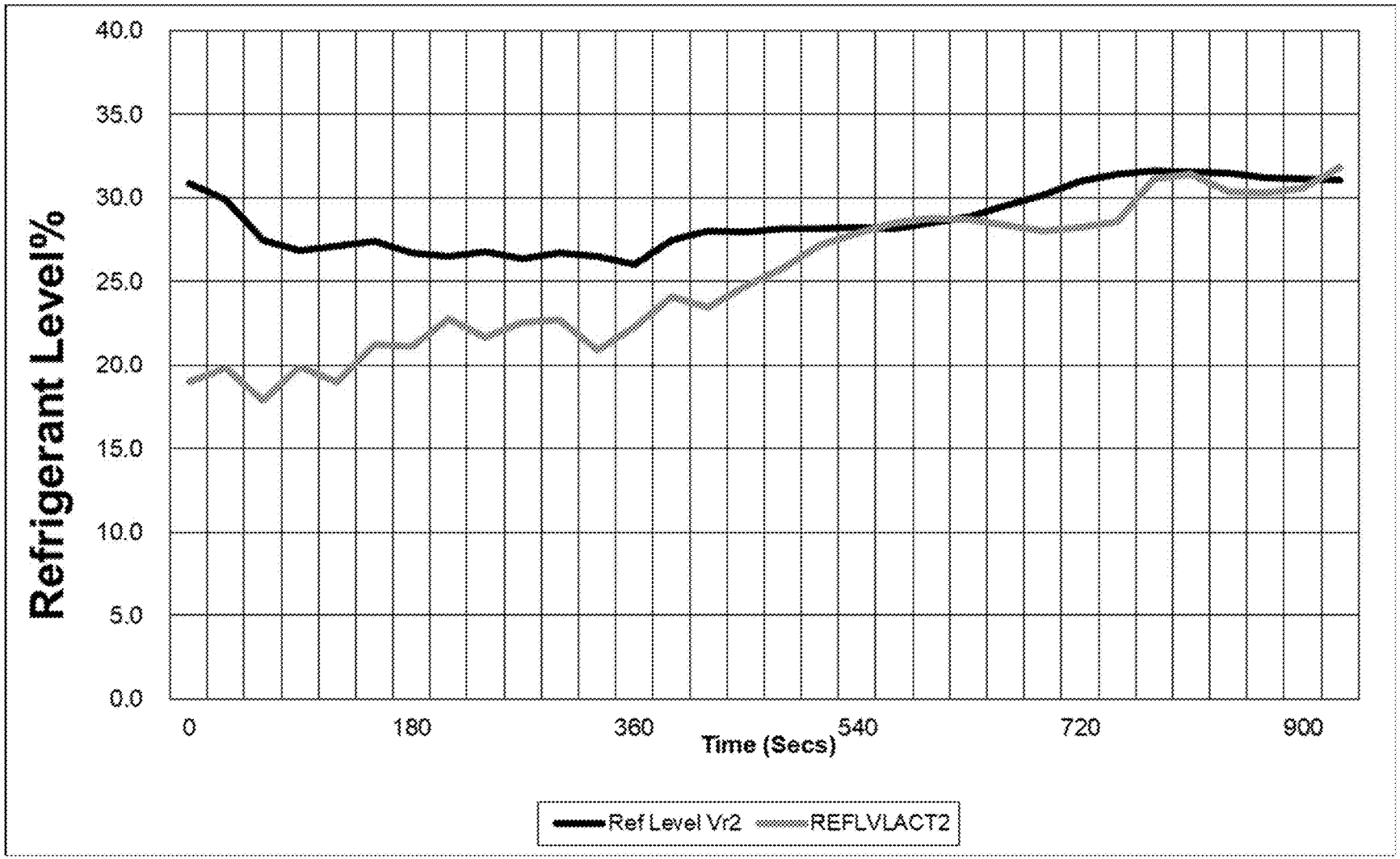
FIG. 8 shows comparison of actual and virtual refrigerant level during start-up of the chiller of a second circuit, according to the present invention.

FIG. 8 shows comparison of actual and virtual refrigerant level during start-up of the chiller of a second circuit, according to the present invention. Repeatability can be observed in the variation of actual and virtual refrigerant level during the first 3 minutes of start-up.

Figure 9:
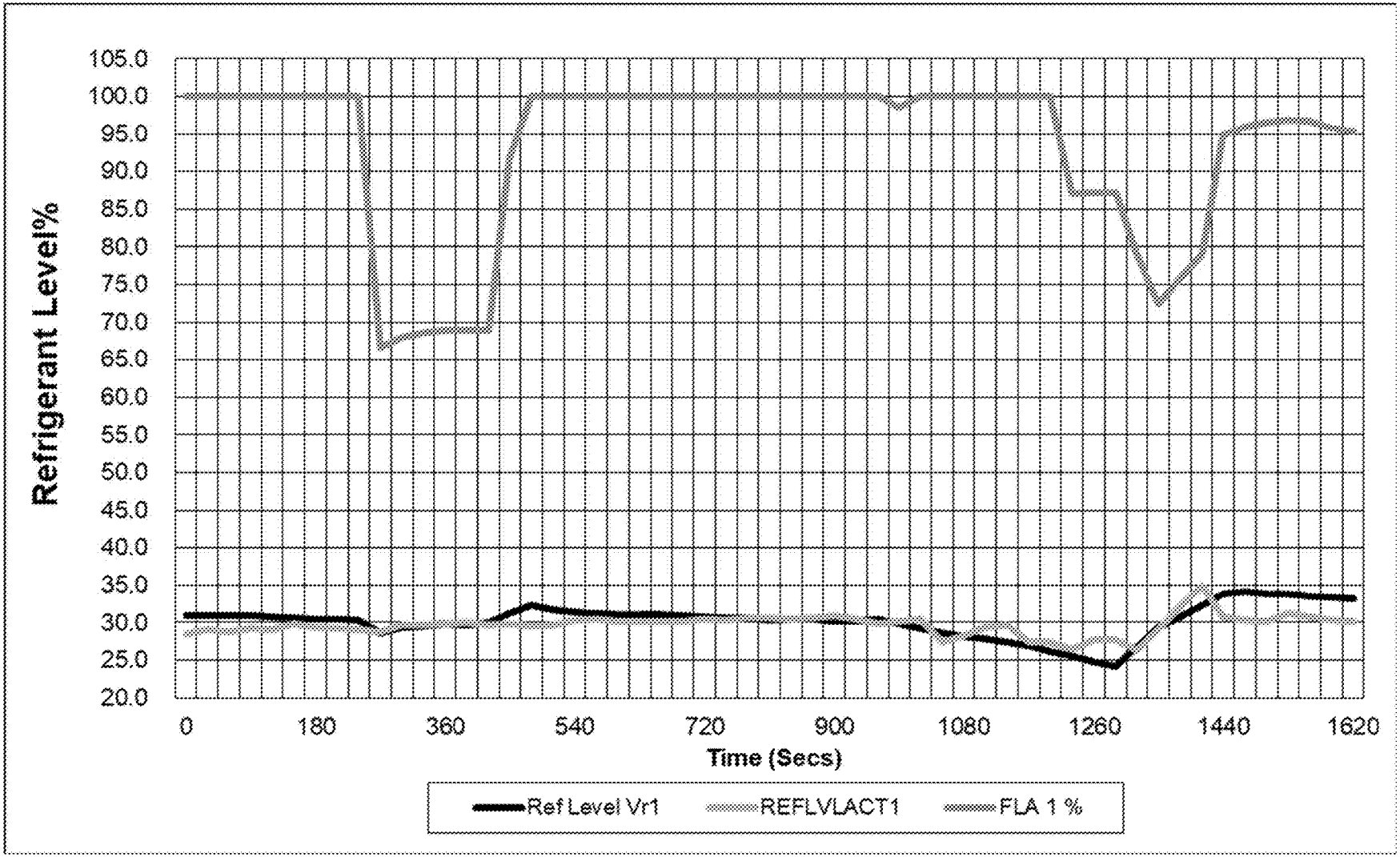
FIG. 9 shows comparison of actual and virtual refrigerant level during operation of the chiller of a first circuit, according to the present invention.

Referring FIG. 9 shows comparison of actual and virtual refrigerant level during operation of the chiller of a first circuit, according to the present invention. The operating conditions as well as the percentage loading of the chiller was varied. From the figure, it can be seen that the actual and virtual refrigerant level are matching with each other under different operating conditions and at different percentage loading of the compressor.

Figure 10:
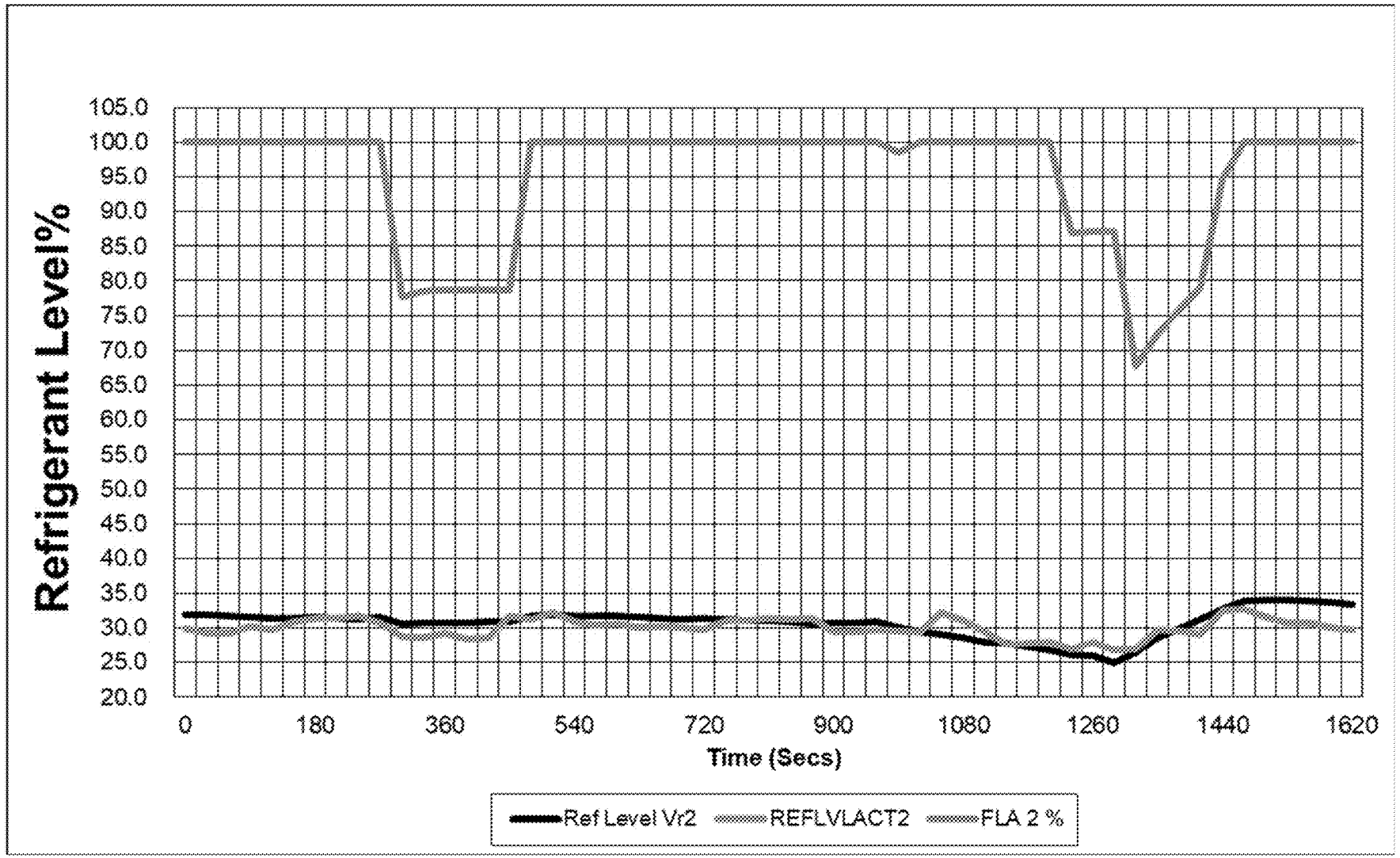
FIG. 10 shows comparison of actual and virtual refrigerant level during operation of the chiller of a second circuit, according to the present invention.

Referring FIG. 10 shows comparison of actual and virtual refrigerant level during operation of the chiller of a second circuit, according to the present invention. Repeatability can be observed in the values of actual and virtual refrigerant level of the second circuit.

Figure 11:
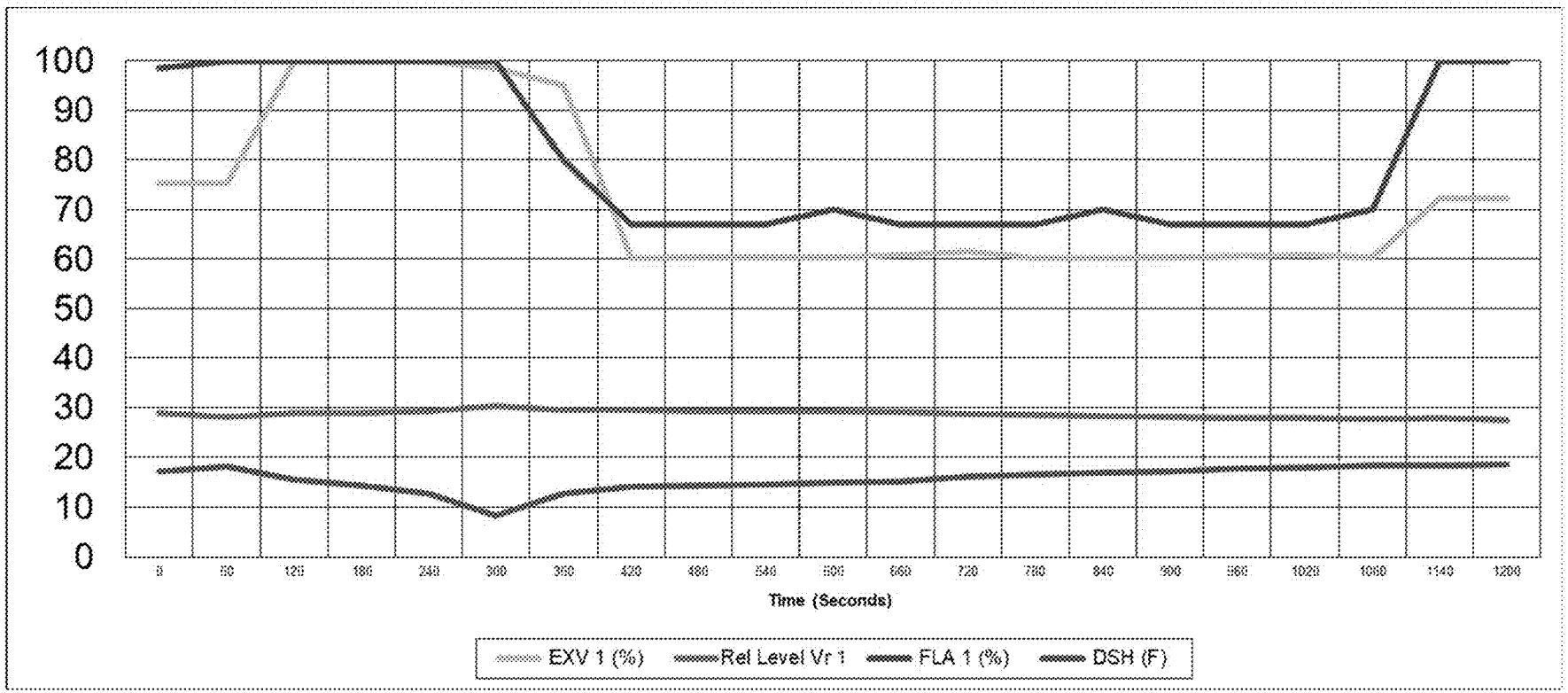
FIG. 11 shows a graph for oil detection and recovery using virtual refrigerant level, according to the present invention; and Persons skilled in the art will appreciate that elements in the figures are illustrated for simplicity and clarity and may have not been drawn to scale. For example, the dimensions of some of the elements in the figure may be exaggerated relative to other elements to help to improve understanding of various exemplary embodiments of the present disclosure.

Referring FIG. 11 shows a graph for oil detection and recovery using virtual refrigerant level, according to the present invention. To create a condition of oil in the evaporator, the electronic expansion valve was fully opened to 100%. Manually opening the EXV results in a high level of refrigerant in the evaporator. This results in liquid refrigerant flood back One of the effect of oil in the evaporator is a low discharge superheat which can be seen in the figure. After creating this condition, the EXV was shifted to auto mode controlled by the controller of the Chiller. The controller detected oil in the evaporator and unloaded the Chiller. This is reflected in the value of FLA reducing to 67%. The controller also increased the virtual refrigerant level. Increase in virtual refrigerant level resulted in closing the Electronic Expansion Valve to 60%. The controller maintained this condition till it detected that oil is sufficiently removed from the evaporator and loaded the Chiller to 100%. The virtual refrigerant level also drops resulting in the Electronic expansion valve opening to 72%. The effect of removal of oil from the evaporator can be seen in the increase in value of discharge superheat to 18° F.

Advantages

1. The operation of EXV based on the virtual refrigerant level reduces the cost substantially as the Entire Level Sensor and Level Sensor Assembly is removed.

2. The EXV operation is simplified ensuring more stable operation of the Chiller.

3. The EXV Operation in Oil Carryover condition ensures that the oil returns automatically without any outside interference 4. Low Suction Pressure EXV operation enables the Chiller to operate in case of lessees Water Flow in Evaporator or in case of refrigerant gas leakage.

The present invention has been described in the context of a control logic for a valve arrangement in an expansion device that controls the flow of refrigerant from a condenser and to an evaporator in a chiller system, thereby controlling the level of liquid refrigerant in the evaporator. However, the control logic of the present invention can be used in any type of refrigeration system to control the level of a fluid contained in a heat exchanger shell, e.g., condenser shell or evaporator shell, or in a receiver, e.g., economizer tank. To use the control logic in other types of refrigeration systems, some changes may have to be made to the membership functions and the sensor information that is used by the control logic to account for the particular configuration of the system to which the control logic is being applied. The present invention has been described in the context controlling level of liquid within an evaporator of a flooded-type chiller without level sensors, however the method and systems can be adapted to different refrigerant systems.

In the foregoing detailed description of aspects embodiments of the invention, various features are grouped together in a single embodiment for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus, the following claims are hereby incorporated into the detailed description of aspects, embodiments of the invention, with each claim standing on its own as a separate embodiment.

It is understood that the above description is intended to be illustrative, and not restrictive. It is intended to cover all alternatives, modifications and equivalents as may be included within the spirit and scope of the invention as defined in the appended claims. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" is used as the plain-English equivalent of the respective term "comprising" respectively.

| NOMENCLATURE | |
|---|---|
| TR—Ton of Refrigeration | EXV Mult—EXV Multiplier |
| EXV—Electronic Expansion Valve | DSHF—Discharge Superheat Factor |
| FLA: Full load amps | Vr Ref Lvl—Virtual Refrigerant Level |
| SV: Solenoid Valve | EXV Mult—EXV Multiplier |
| SP: Suction Pressure | A—Current |
| DP: Discharge Pressure | PR—Pressure Ratio |
| LWT—Leaving Water Temperature | DSH—Discharge Superheat |
| DT—Discharge Temperature | Vr Act—Actual Refrigerant Level |
| LF—Load Factor | |

What is claimed is:

1. A method of controlling a level of liquid within an evaporator of a flooded-type chiller without level sensors, the flooded-type chiller including at least one compressor, a condenser, expansion valve and an evaporator being arranged in series, the method comprising:

measuring a plurality of first group of parameters using a plurality of sensors positioned in the flooded-type chiller;

calculating a plurality of second group of parameters using the measured value of the first group of parameters by a controller having at least one processor, wherein the processor is in communication with said plurality of sensors;

determining a virtual refrigerant level as a control signal based on the second group of parameter values by the controller; and controlling a desired refrigerant level in the evaporator by controlling operation of said expansion valve based on said determined virtual refrigerant level with respect to a dead zone for maintaining a pre-defined target refrigerant level by closing the expansion valve when the virtual refrigerant level is above the dead zone and opening the expansion valve when the virtual refrigerant level is below the dead zone.

2. The method as claimed in claim 1, further comprising monitoring the operation of the flooded-type chiller at a pre-defined time interval.

3. The method as claimed in claim 1, wherein a predefined time interval at starting of the flooded-type chiller is 2-5 minutes and the predefined time interval during continuous operation of the flooded-type chiller is 10-60 seconds.

4. The method as claimed in claim 1, wherein the pre-defined target refrigerant level is in the range of 20 to 35%.

5. The method as claimed in claim 1, wherein the closing of the expansion valve comprises invoking said control signal to close said expansion valve by increasing virtual refrigerant level above the dead zone when there is decrease of discharge superheat caused due to excess oil in said evaporator, thereby unloading the evaporator to return the oil to an oil separator and wherein the opening of the expansion valve comprises invoking said control signal to open said expansion valve by decreasing virtual refrigerant level below the dead zone, thereby increasing discharge superheat.

6. The method as claimed in claim 1, wherein said controller invokes said control signal to hold said expansion valve when said determined virtual refrigerant level in the dead zone.

7. The method as claimed in claim 1, wherein said second group of parameters include pressure ratio, discharge superheat, full load electric current, load factor, EXV multiplier and discharge superheat factor.

8. A method of controlling a level of liquid within an evaporator of a flooded-type chiller without level sensors, the flooded-type chiller including at least one compressor, a condenser, expansion valve and an evaporator being arranged in series, the method comprising:

measuring a plurality of first group of parameters using a plurality of sensors positioned in the flooded-type chiller;

calculating a plurality of second group of parameters using the measured value of the first group of parameters by a controller having at least one processor, wherein the processor is in communication with said plurality of sensors;

determining a virtual refrigerant level as a control signal based on the second group of parameter values by the controller; and controlling a desired refrigerant level in the evaporator by controlling operation of said expansion valve based on said determined virtual refrigerant level with respect to a dead zone for maintaining a pre-defined target refrigerant level;

wherein when a suction pressure reduces and reaches a pre-defined low suction pressure setpoint, said controller invokes said control signal to open said expansion valve, till said suction pressure is more than said pre-defined low suction pressure setpoint.

9. The method as claimed in claim 8, wherein the pre-defined low pressure setpoint is calculated by the controller based on measured values of said plurality of first group of parameters.

10. A method of controlling a level of liquid within an evaporator of a flooded-type chiller without level sensors, the flooded-type chiller including at least one compressor, a condenser, expansion valve and an evaporator being arranged in series, the method comprising:

measuring a plurality of first group of parameters using a plurality of sensors positioned in the flooded-type chiller;

calculating a plurality of second group of parameters using the measured value of the first group of parameters by a controller having at least one processor, wherein the processor is in communication with said plurality of sensors;

determining a virtual refrigerant level as a control signal based on the second group of parameter values by the controller; and controlling a desired refrigerant level in the evaporator by controlling operation of said expansion valve based on said determined virtual refrigerant level with respect to a dead zone for maintaining a pre-defined target refrigerant level;

wherein said first group of parameters include suction pressure, discharge pressure, leaving water temperature, discharge temperature and electric current.

* * * * *